US006055779A

United States Patent [19]

Yang

[11] Patent Number: 6,055,779

[45] Date of Patent: May 2, 2000

[54] DEVICE FOR DAMPING CLOSING MOVEMENT OF LID

[75] Inventor: Se-Ii Yang, Seoul, Rep. of Korea

[73] Assignee: Samick Musical Instruments Co., Ltd, Inchon, Rep. of Korea

[21] Appl. No.: 09/186,569

[22] Filed: Nov. 5, 1998

[30] Foreign Application Priority Data

Dec. 17, 1997 [KR] Rep. of Korea ..... 97-38127

[51] Int. Cl.[7] ..... E05F 1/10

[52] U.S. Cl. ..... 49/386

[58] Field of Search ..... 49/324, 333, 334, 49/335, 338, 339, 340, 341, 386; 74/574

[56] References Cited

U.S. PATENT DOCUMENTS

| | | | |
|---|---|---|---|
| 4,401,260 | 8/1983 | Grant | 49/334 X |
| 4,833,827 | 5/1989 | Bode et al. | 49/335 X |
| 5,398,448 | 3/1995 | Kaufass | 49/334 |
| 5,438,799 | 8/1995 | LeFaucheur | 49/334 X |

*Primary Examiner*—Jerry Redman

*Attorney, Agent, or Firm*—Jonathan Y. Kang; Lee & Hong

[57] ABSTRACT

A damper for lids having a configuration capable of allowing a closing hinge movement of a lid to be slowly carried out, thereby preventing an abrupt closing of the lid. The damper includes a lid connecting lever hingably mounted at one end thereof to a damper housing mounted in an article and fixed at the other end thereof to a lid of the article, and a damping lever connected at one end thereof to the lever shaft, a U-shaped cylinder defined in the damping housing and contained with a fluid, the cylinder being divided into a first compression chamber and a second compression chamber, a check valve arranged in the first compression chamber, the check valve being open when the fluid flows from the second compression chamber to the first compression chamber, a communication port formed through the check valve to communicate the first and second compression chambers with each other, a first plunger arranged above the check valve, a pushing rod extending upwardly from the first plunger and having a tip protruding upwardly through the damper housing in such a manner that the other end of the damping lever comes into contact with the tip in the process of the movement of the lid toward its open position, and a second plunger arranged in the second compression chamber.

11 Claims, 12 Drawing Sheets

DEVICE FOR DAMPING CLOSING MOVEMENT OF LID

BACKGROUND OF THE INVENTION

1. Field of the Invention

The present invention relates to a damper for allowing a vertical hinge movement of a lid upon opening or closing the lid, particularly, upon closing the lid, to be slowly carried out, and more particularly to a damper for allowing a closing movement of a lid such as a piano keyboard lid or other lids made of a fragile material, e.g., glass, to be slowly carried out.

2. Description of the Prior Art

Generally, doors, which are installed at entrances and exits of buildings, may have drawbacks in that they may be abruptly closed, thereby generating loud noise or causing persons passing therethrough to be injured. In particular, such loud noise may cause the atmosphere of the room, where a door is installed, to be uncomfortable. For instance, persons present in the room may be startled all of a sudden due to the loud noise.

In order to solve such drawbacks, dampers have been proposed which serve to allow the closing movement of a door to be slowly carried out.

However, all known dampers are used only for doors involving a horizontal hinge movement. In other words, there is no damper allowing a closing movement of a lid involving a vertical hinge movement to be slowly carried out, in spite of the fact that such lids have the same problem as doors involving a horizontal hinge movement. In particular, more severe problems may occur in the case of heavy lids such as piano keyboard lids.

That is, a heavy lid such as a piano keyboard lid may be abruptly closed due to its weight, thereby generating loud noise or causing a person, who closes the lid, to be injured at his fingers by the lid, unless the person continuously grasps the lid until the lid reaches its closed position. Furthermore, when the lid is abruptly closed, it may apply an impact to other parts of the article on which the lid is mounted. As a result, the article itself may be damaged.

In the case of lids made of a fragile material such as glass and having a slippery surface, they themselves may also be damaged when they are abruptly closed.

SUMMARY OF THE INVENTION

Therefore, the present invention has been made in view of the above mentioned problems involved in the prior art, and an object of the invention is to provide a damper having a configuration capable of allowing a closing hinge movement of a lid to be slowly carried out, thereby preventing an abrupt closing of the lid.

In accordance with the present invention, this object is accomplished by providing A damper for a lid, the lid being hingably mounted at opposite lateral ends thereof to an article and adapted to open and close a desired portion of the article, comprising: a damper housing fixedly mounted in a portion of the article facing each lateral end of the lid, the damper housing having a mounting wall vertically flush with the article portion facing the lateral end of the lid; a lever unit hingably mounted to the mounting wall of the damper housing and connected to the lid to serve as a hinge for the lid, the lever unit moving hingably between a first position corresponding to a open position of the lid and a second position corresponding to a closed position of the lid, the lever unit including a lever shaft rotatably fitted in a hole formed in the mounting wall of the damper housing, a lid connecting lever fixedly mounted at one end thereof to one end of the lever shaft protruded beyond the hole while extending perpendicularly to the lever shaft, the other end of the lid connecting lever being fixed to the lid, a damping lever fixedly mounted to the other end of the lever shaft while extending perpendicularly to the lever shaft, a smaller-diameter shaft extending from the other end of the lever shaft such that it is arranged concentrically with the lever shaft, and a roller rotatably fitted around the smaller-diameter shaft; and a damping unit arranged in the interior of the damper housing, the damping unit being operatively connected to the lever unit in such a manner that it damps a force effecting the movement of the lever unit toward the first position, the damping unit including a U-shaped cylinder defined in the damper housing and contained with a fluid, the cylinder being divided into a first compression chamber and a second compression chamber communicating with each other at lower ends thereof, a check valve arranged at a lower portion of the first compression chamber, the check valve being closed when a fluid in the cylinder flows from the first compression chamber to the second compression chamber while being open when the fluid flows from the second compression chamber to the first compression chamber, a small-diameter communication port formed through the check valve and adapted to communicate the first and second compression chambers with each other, a first plunger arranged in the first compression chamber above the check valve such that it reciprocates vertically, a pushing rod extending vertically from the upper surface of the first plunger and having a tip protruding upwardly through a hole formed in a top wall of the damper housing, the tip of the pushing rod being arranged in a path along which the roller of the lever unit moves together with the damping lever during the movements of the lid, and a second plunger arranged in the second compression chamber such that it reciprocates vertically; whereby the roller of the lever unit comes into contact with the tip of the pushing rod included in the damping unit in the process of the movement of the lid toward the open position, so that the force effecting the movement of the lid toward the open position to is damped by virtue of the function of the check valve.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1A:
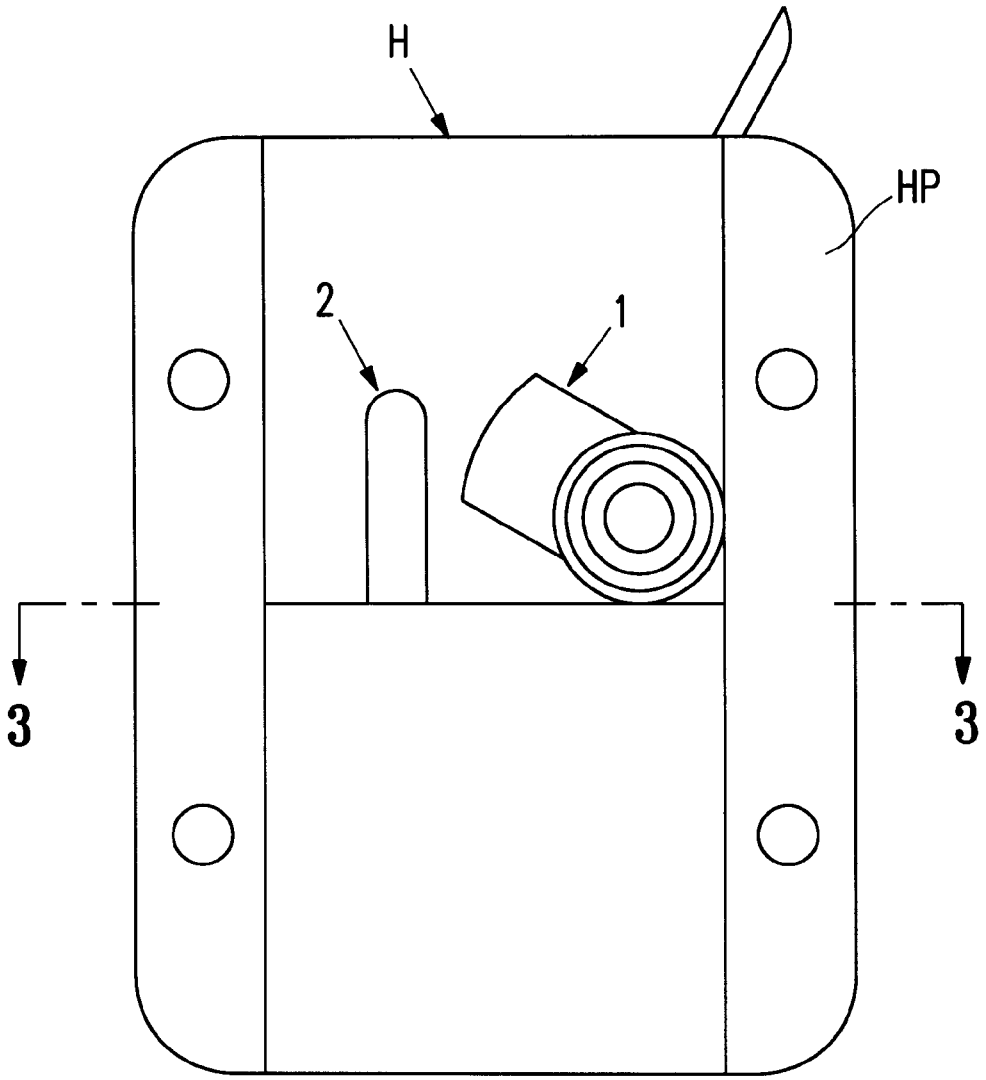
FIG. 1*a* is a front view illustrating a damper according to a first embodiment of the present invention.
Figure 1B:
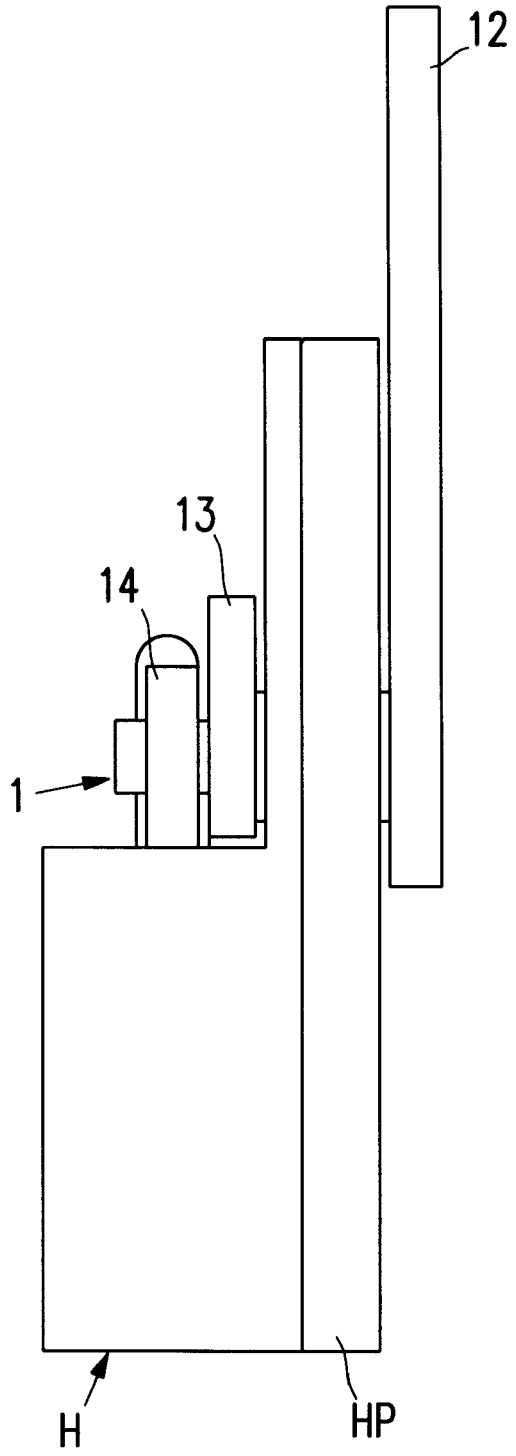
FIG. 1*b* is a side view illustrating the damper shown in FIG. 1*a;*

Referring to FIGS. 1*a* and 1*b*, a damper according to a first embodiment of the present invention is illustrated, respectively. As shown in FIGS. 1*a* and 1*b*, the damper of the present invention is connected to a lid, for example, a piano keyboard lid, and adapted to damp a closing hinge movement of the lid. The damper includes a damper housing H, a lever unit 1 mounted to a mounting wall HP of the housing H, and a damping unit 2 provided with a cylinder defined in the interior of the damper housing H. The cylinder of the damping unit 2 is defined with a chamber in which a fluid is contained.

Figure 2:
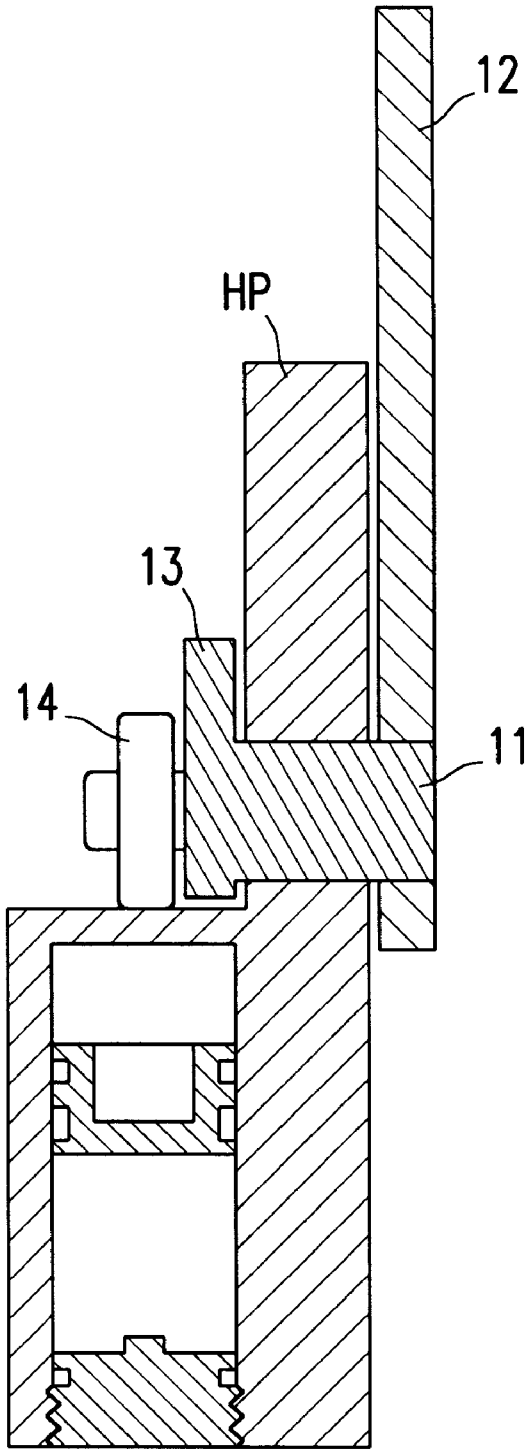
FIG. 2 is a cross-sectional view illustrating the damper shown in FIG. 1*a;*

As best shown in FIG. 2, the lever unit 1 includes a lever shaft 11 rotatably fitted in a hole formed in the mounting wall HP of the damper housing H, a lid connecting lever 12 fixedly mounted to one end of the lever shaft 11 protruded beyond the hole. The lid connecting lever 12 extends perpendicularly to the lever shaft 11. The lever unit 1 also includes a damping lever 13 fixedly mounted to the other end of the lever shaft 11 such that it extends perpendicularly to the lever shaft 11. A smaller-diameter shaft extends from the other end of the lever shaft 11 such that it is arranged concentrically with the lever shaft 11. A roller 14 is rotatably fitted around the smaller-diameter shaft.

Figure 3:
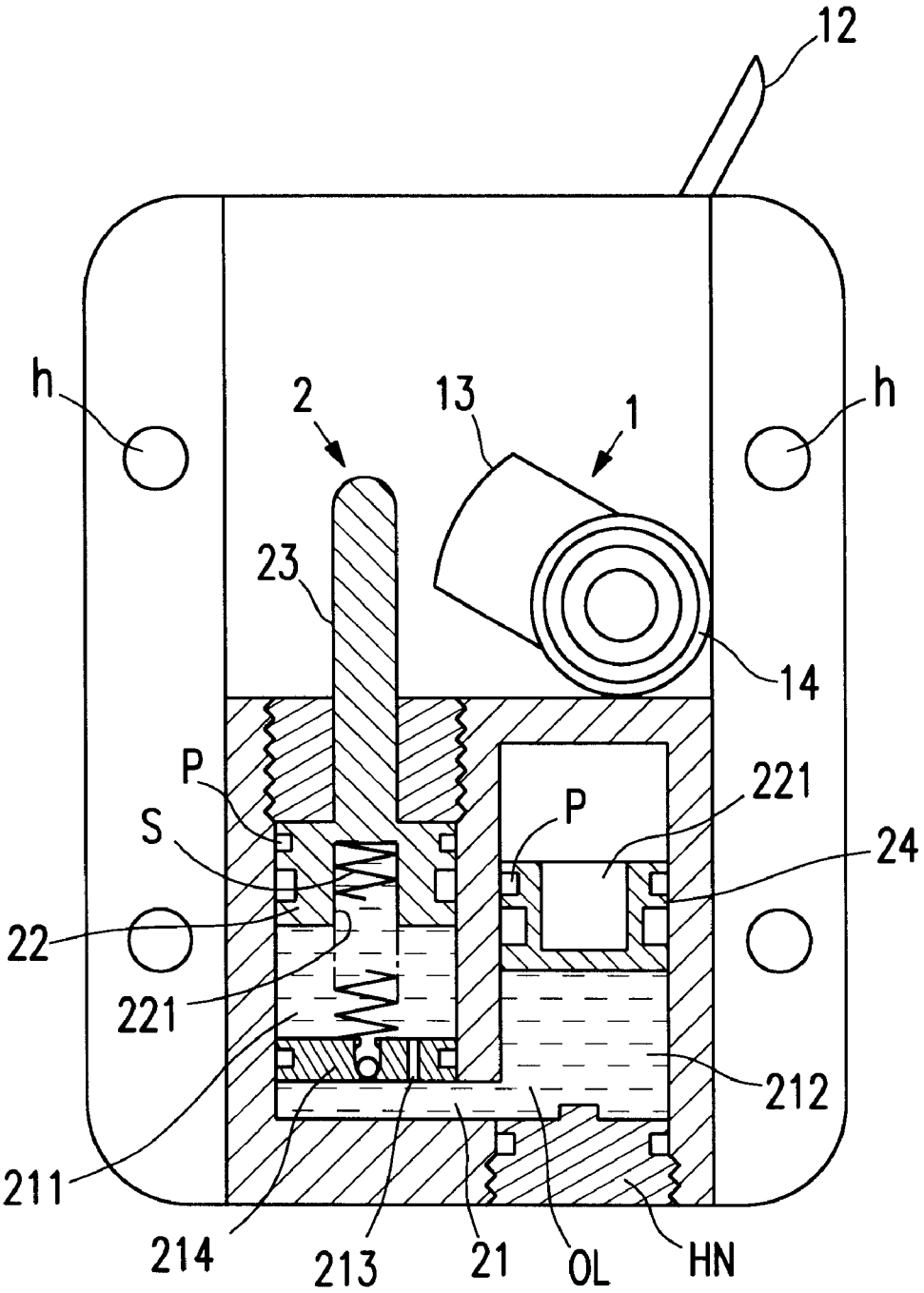
FIG. 3 is a sectional view illustrating the damper shown in FIG.1*a;*

FIG. 3 is a cross-sectional view taken along the line A—A of FIG. 1*a*. As shown in FIG. 3, the damping unit 2 includes a cylinder 21 defined by a U-shaped space formed in the damper housing H. The cylinder 21 has a first compression chamber 211 at its left portion and a second compression chamber 212 at its right portion. The first and second compression chamber 211 and 212 communicate with each other at their lower ends.

A check valve 214 is arranged at the lower portion of the first compression chamber 211 in the interior of the first compression chamber 211. A small-diameter communication port 213 is formed through the check valve 214 to communicate the first and second compression chambers 211 and 212 with each other. The check valve 214 is closed when the fluid OL in the cylinder 21 flows from the first compression chamber 211 to the second compression chamber 212 while being open when the fluid OL flows from the second compression chamber 212 to the first compression chamber 211.

A first plunger 22 is arranged in the interior of the first compression chamber 211 above the check valve 214 such that it reciprocates vertically. A pushing rod extends vertically from the upper surface of the first plunger 22. The pushing rod 23 protrudes upwardly through a hole formed in the top wall of the damper housing H. The pushing rod 23 has a round tip. A central recess is formed in the lower surface of the first plunger 22. The central recess is denoted by the reference numeral 221 in the drawings and serves to receive one end of a compression coil spring S. The other end of the compression coil spring S is seated on the upper surface of the check valve 214. The compression coil spring S serves to always urge the first plunger 22 to move away from the check valve 214. A second plunger 24 is arranged in the interior of the second compression chamber 212 such that it reciprocates vertically.

As apparent from the above description, the fluid OL is filled in the interior of the cylinder 21 between the first and second plungers 22 and 24 received in the cylinder 21. The fluid OL flows between the first and second compression chambers 211 and 212 through the communication port 213.

A threaded hole is formed through a portion of the housing H corresponding to the bottom of the second compression chamber 212, as shown in FIG. 3. A bolt HN is coupled to the threaded hole.

Upon assembling the second plunger 24 in the cylinder 21, the second plunger 24 is inserted into the second compression chamber 213 through the open threaded hole formed at the bottom of the second compression chamber 213. Thereafter, the bolt HN is coupled to the threaded hole in order to close the threaded hole.

In FIG. 3, the reference character P denotes packing rings, and the reference character h denotes fixing bolt holes.

By the above mentioned configuration, the lever unit 1 and damping unit 2 are operatively connected as the pushing rod 23 of the damping unit 2 comes into contact with the outer surface of the roller 14 of the lever unit 1 (FIGS. 1 and 3).

Figure 4:
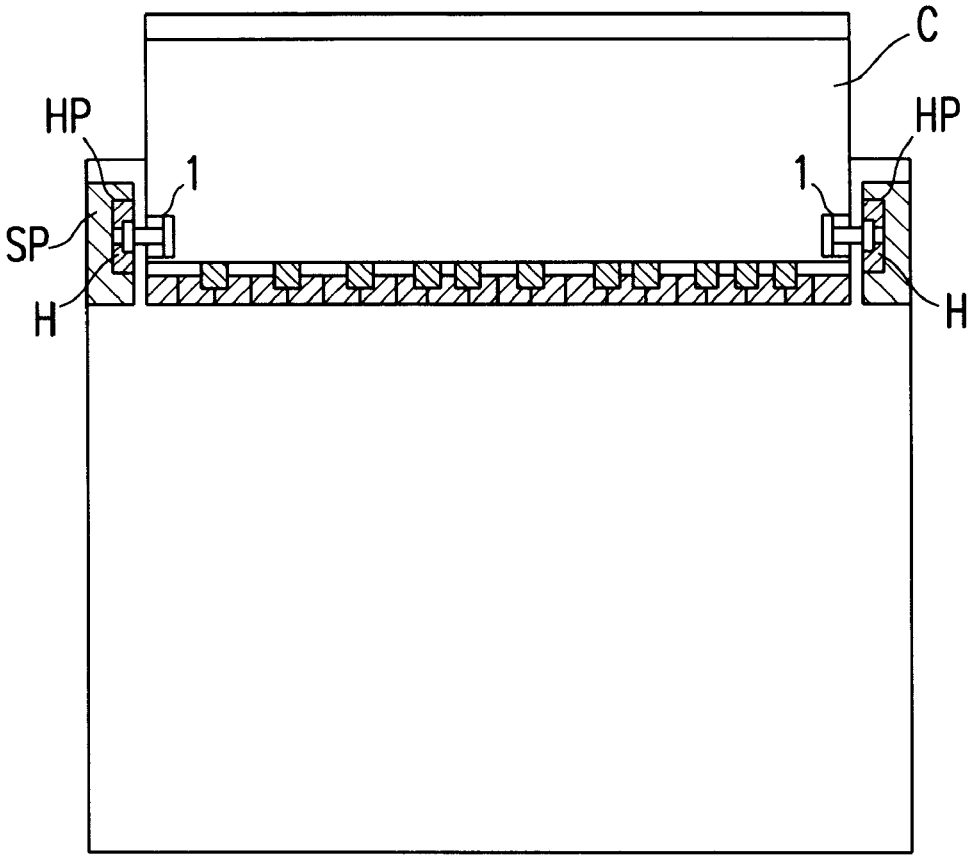
FIG. 4 is a front view of a piano to which the damper shown in FIG. 1*a* is attached.

FIG. 4 is a front view of a piano to which two dampers having the above mentioned configuration according to the present invention are attached. As shown in FIG. 4, the dampers of the present invention are attached to opposite side plates included in the body of the piano and connected to opposite side walls SP of the lid of the piano, respectively. The dampers also serve as hinges for the piano lid at the opposite sides of the piano lid. Each damper is mounted to an associated side plate SP of the piano body in such a manner that its damping unit 2 is received in a recess formed in the side plate SP. At this time, the mounting wall HP of the housing H is flush with the side plate SP.

Now, an operation of the damper of the present invention, which is assembled in the piano, will be described in conjunction with FIGS. 5*a* to 5*e*.

Figure 5A:
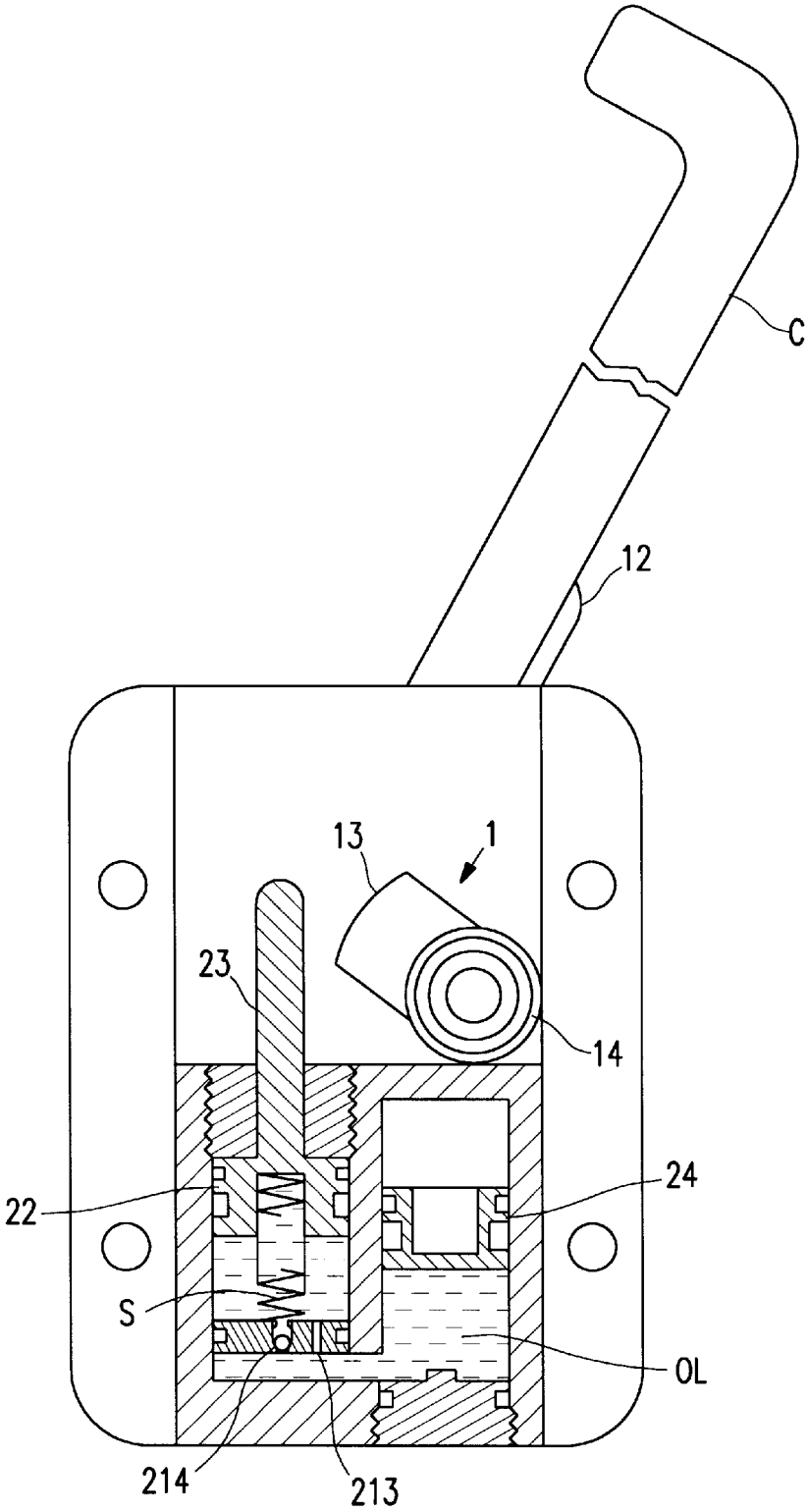
FIGS. 5*a* to 5*e* are sectional views respectively illustrating different operation states of the damper shown in FIG.1*a;*

FIG. 5*a* illustrates a state of the damper when the keyboard lid of the piano is completely open. In this state, the lid connecting lever 12 fixedly mounted at the other end thereof to the outer surface of the keyboard lid C is maintained at its completely open state. At the completely open state of the keyboard lid C, the roller 14 of the lever unit 1 is positioned at its rear position where it is laid on an upper surface portion of the housing H defining the second compression chamber 212 of the damping unit 2.

Figure 5B:
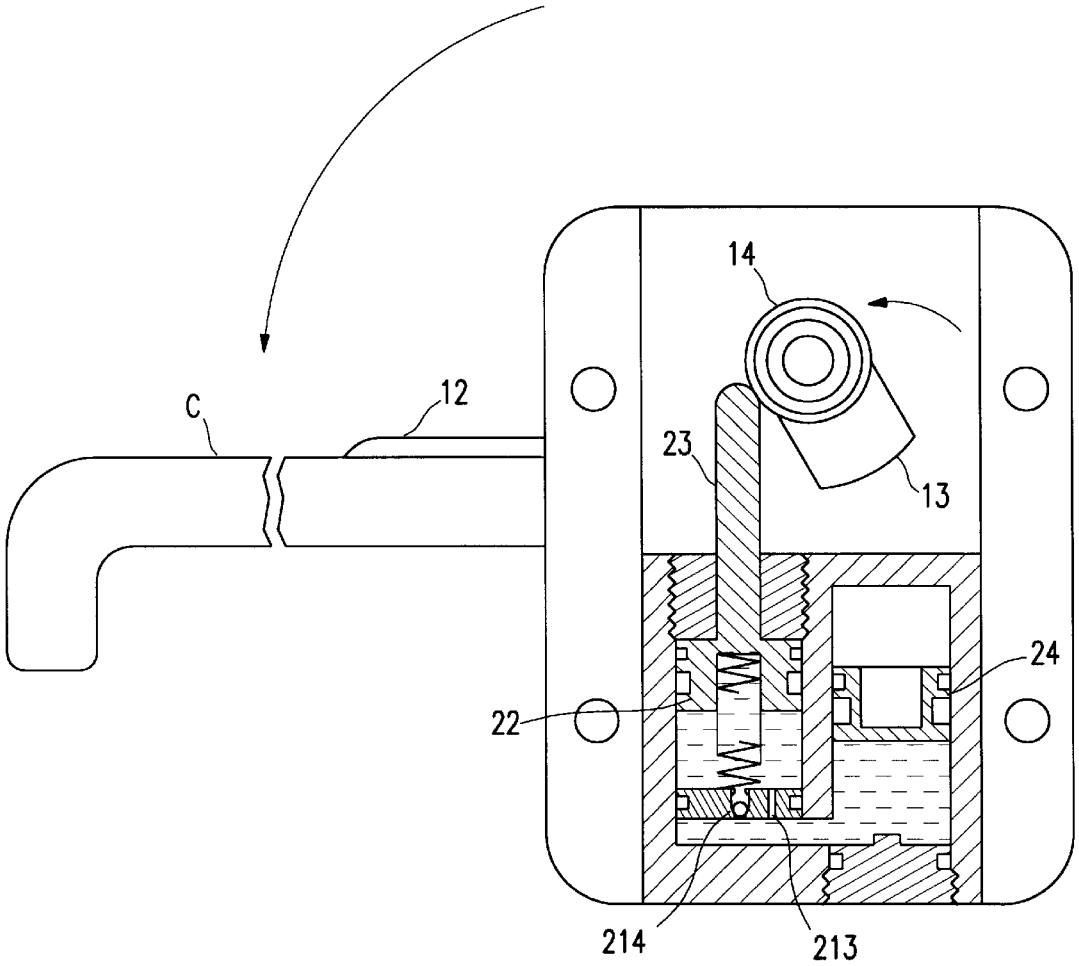

When the user pivotally lowers the keyboard lid C toward the keyboard to close the keyboard lid C, the lid connecting lever 12 also moves pivotally along with the keyboard lid C. During the pivotal movement of the lid connecting lever 12, the roller 14 of the lever unit 1 comes into contact with the tip of the pushing rod 23, as shown in FIG. 5*b*. From this state, the roller 14 applies the weight of the keyboard lid C, which is transmitted thereto via the lid connecting lever 12, lever shaft 11 and damping lever 13, to the tip of the pushing rod 23.

Figure 5C:
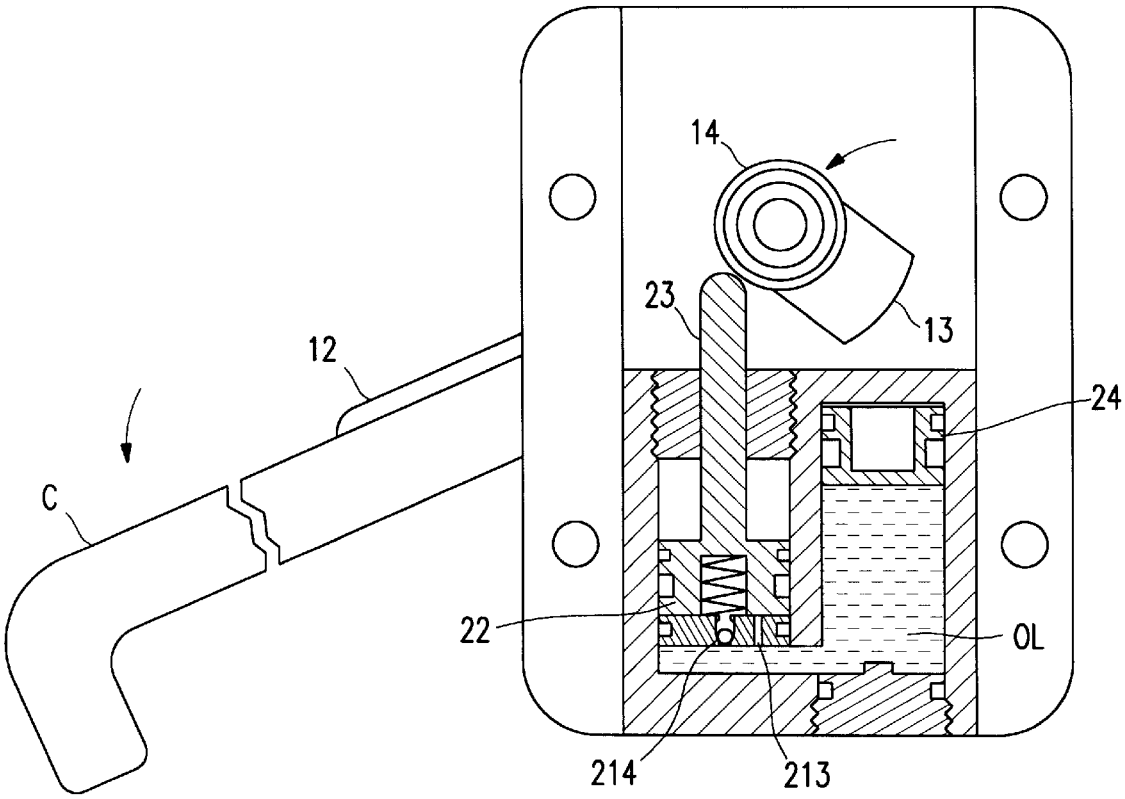

As the roller 14 downwardly pushes the pushing rod 23, the first plunger 22 provided at the lower end of the pushing rod 23 moves downwardly against the resilience of the spring S while applying pressure to the fluid OL contained in the first compression chamber 211, as shown in FIG. 5*c*. At this time, the pressurized fluid OL cannot pass through the check valve 214 because the check valve 214 is closed when the fluid OL in the cylinder 21 flows from the first compression chamber 211 to the second compression chamber 212. Accordingly, the pressurized fluid OL flows into the second compression chamber 212 only via the communication port 213. As the pressurized fluid OL is introduced into the second compression chamber 212, the fluid contained in the second compression chamber 212 is pressurized, thereby upwardly moving the second plunger 24.

The flow of the fluid OL from the first compression chamber 211 to the second compression chamber 212 is slowly carried out because it is achieved only via the communication port 213 having a small diameter by virtue of the function of the check valve 214 preventing it. Accordingly, the downward movement of the first plunger 22 is slowly carried out even when the weight of the keyboard lid C is applied to the pushing rod 23 all at once. The resilience of the spring S arranged beneath the first plunger 22 also assists the check valve 214 to slowly carry out the downward movement of the first plunger 22.

Since the downward movements of the first plunger 22 and pushing rod 23 are slowly carried out, the keyboard lid C moves slowly to its closed position where it completely covers the keyboard, as shown in FIG. 5*c*.

Figure 5D:
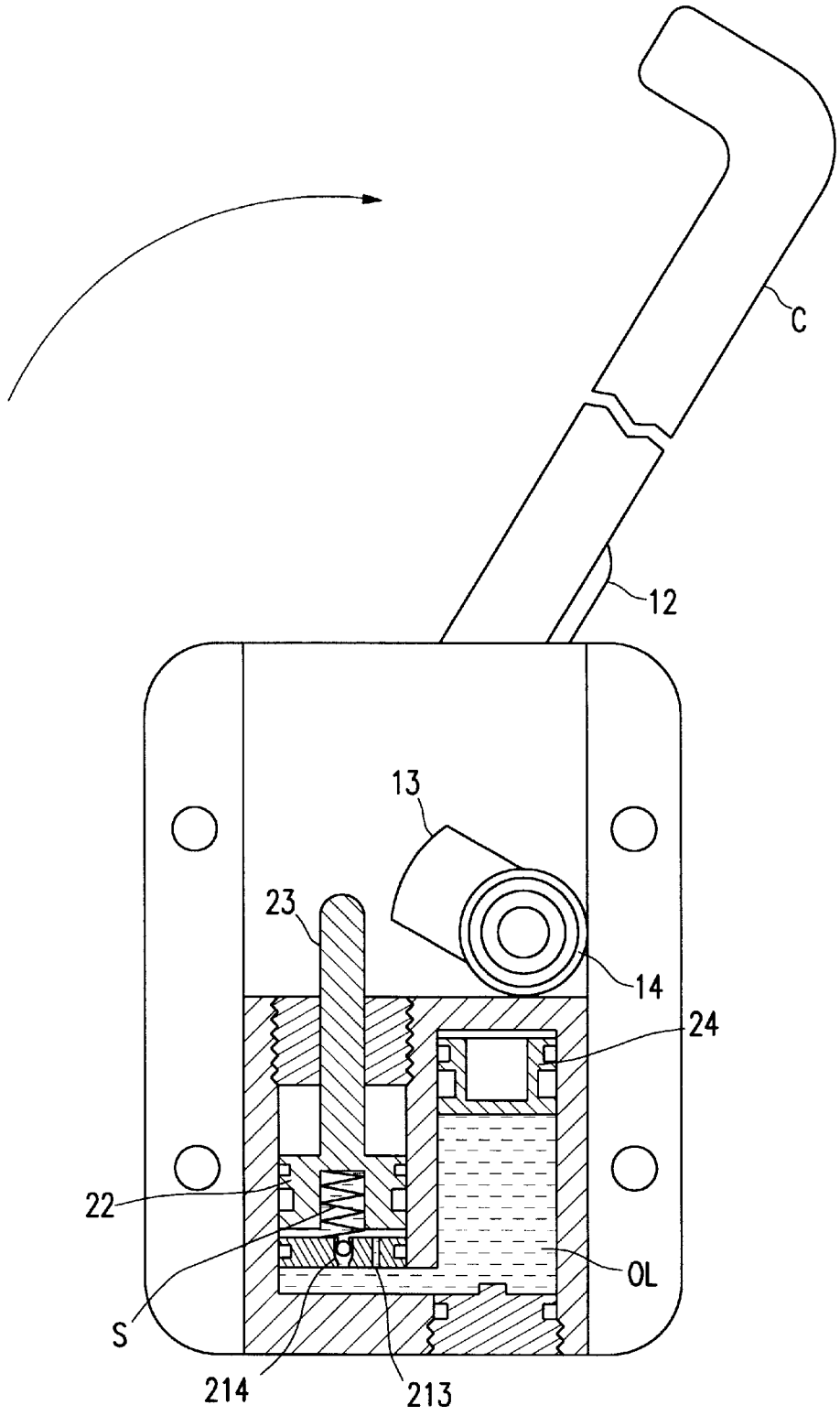
Figure 5E:
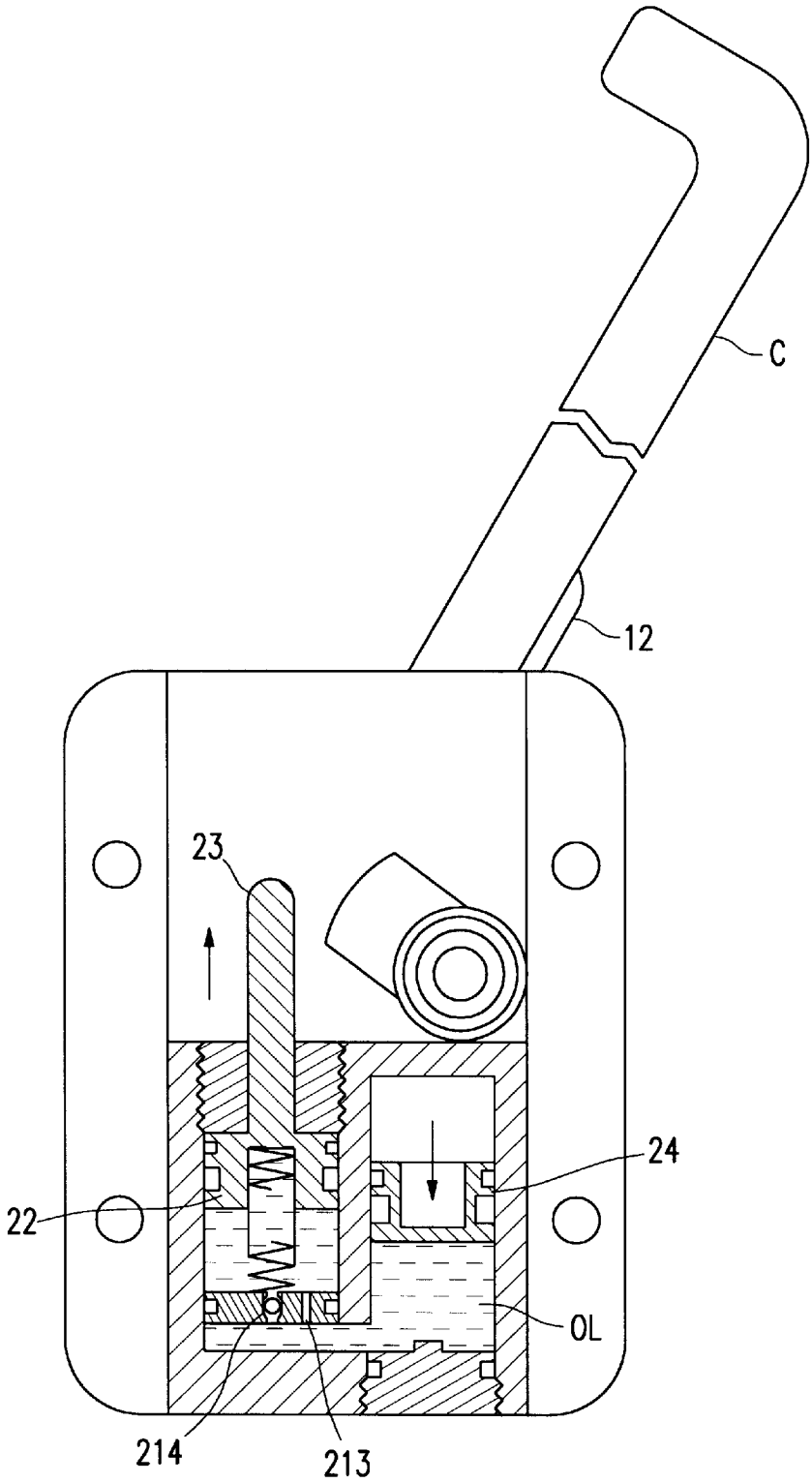

FIG. 5*d* illustrates a state in which the user opens the keyboard lid C upon playing the piano, thereby pivotally moving the keyboard lid C to its completely open position. When the keyboard lid C moves to its completely open position, the lid connecting lever 12 also moves to its original position shown in FIG. 5*a*, along with the roller 14 of the lever unit 1. By this movement, the pushing rod 23 is released from the roller 14.

When the pushing rod 23 is released from the roller, it is raised by the resilience of the compressed spring S. As the pushing rod 23 moves upwardly, the fluid OL contained in the second compression chamber 212 is sucked into the first compression chamber 211 through the check valve 214, which is in its open state, and the communication port 213. Accordingly, the upward movement of the first plunger 11 is rapidly carried out, as compared to the downward movement of the first plunger 11. This enables the pushing rod 23 to reach rapidly its completely raised position shown in FIG. 5*e*.

Thus, when the player opens the keyboard lid C to play the piano, the damper of the present invention reaches rapidly the state shown in FIG. 5*a*. When the player closes the keyboard lid C after playing the piano, the keyboard lid C reaches first a slightly closed state where the roller 14 comes into contact with the tip of the pushing rod 23. From this state, the weight of the keyboard lid C is applied to the pushing rod 23, so that the keyboard lid C moves slowly to its completely closed position shown in FIG. 5*c*.

Figure 6:
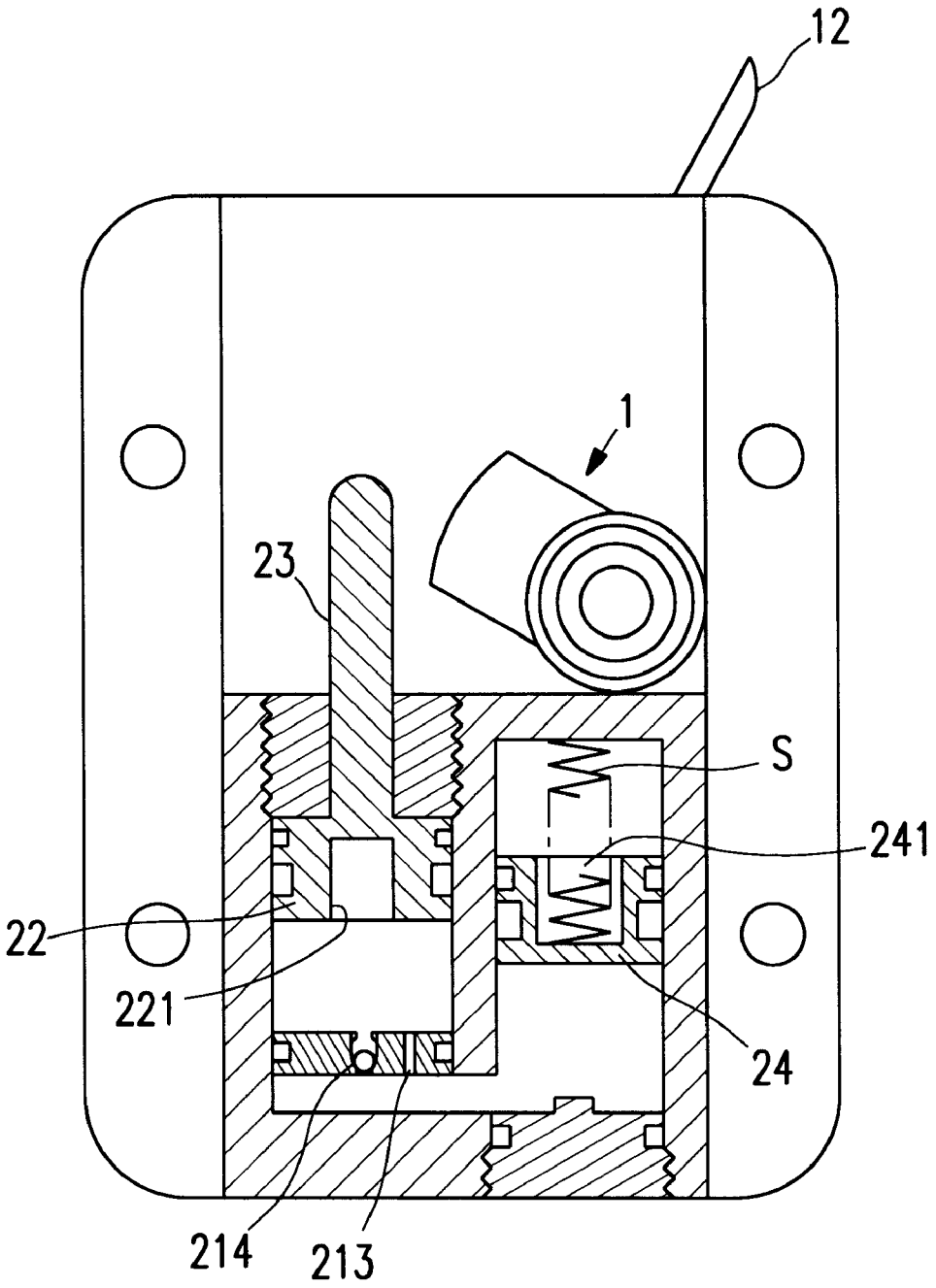
FIG. 6 is a sectional view illustrating a damper according to a second embodiment of the present invention.

FIG. 6 is a sectional view similar to FIG. 3, illustrating a damper according to a second embodiment of the present invention.

The damper of this embodiment has the same configuration as the first embodiment, except that the spring S is not arranged in the first compression chamber 211, but arranged in the second compression chamber 212.

In accordance with this embodiment, the second plunger 24 has a central recess 241 formed in the upper surface thereof in order to receive one end of the spring S. The spring S serves to always urge the second plunger 24 in a downward direction. By virtue of the spring S, the fluid OL in the second compression chamber 212 is always forced to flow toward the first compression chamber 211, thereby causing the first plunger 22 to move upwardly.

That is, the damper of this embodiment has the same function as that of the first embodiment, except that the upward movement of the first plunger 22 is achieved by the resilience of the spring S arranged in the second compression chamber 212.

Figure 7:
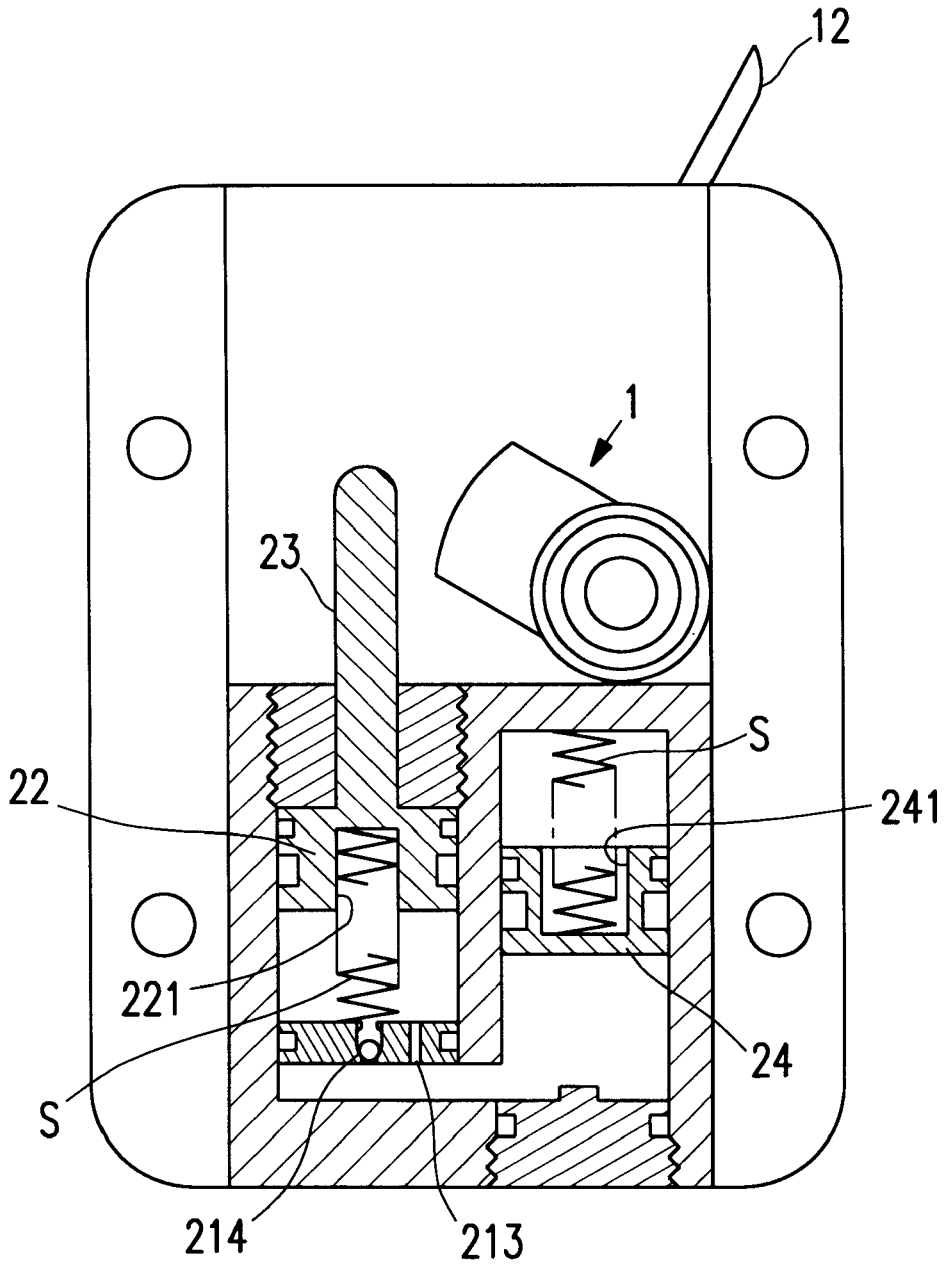
FIG. 7 is a sectional view illustrating a damper according to a third embodiment of the present invention.

FIG. 7 illustrates a damper according to a third embodiment of the present invention. In accordance with this embodiment, two springs S are arranged in both the first and second compression chambers 211 and 212, respectively, in order to achieve a more rapid upward movement of the first plunger 22.

As apparent from the above description, the present invention provides a damper having a configuration capable of allowing a closing hinge movement of a lid to be slowly carried out, thereby preventing an abrupt closing of the lid. In accordance with the damper of the present invention, the problem wherein the heavy piano keyboard lid is abruptly closed due to its weight without the user continuously grasping the lid until the lid reaches its closed position, thereby generating loud noise or causing the user to be injured at his fingers by the lid, is avoided.

Although the preferred embodiments of the invention have been disclosed for illustrative purposes, those skilled in the art will appreciate that various modifications, additions and substitutions are possible, without departing from the scope and spirit of the invention as disclosed in the accompanying claims. For instance, the application of the present invention is not limited to piano keyboard lids. The damper of the present invention may also be applied to other lids having a heavy weight or lids made of a fragile material.

What is claimed is:

1. A damper used with a lid which is hingably mounted at opposite lateral ends thereof to an article and adapted to open and close a desired portion of the article, the damper comprising:

a damper housing fixedly mounted in a portion of the article facing each lateral end of the lid, the damper housing having a mounting wall vertically flush with the article portion facing the lateral end of the lid;

a lever unit hingably mounted to the mounting wall of the damper housing and connected to the lid to serve as a hinge for the lid, the lever unit moving hingably between a first position corresponding to an open position and a second position corresponding to a closed position, the lever unit including a lever shaft rotatably fitted in a hole formed in the mounting wall of the damper housing, a lid connecting lever fixedly mounted at one end thereof to one end of the lever shaft protruded beyond the hole while extending perpendicularly to the lever shaft, the other end of the lid connecting lever being fixed to the lid, a damping lever fixedly mounted to the other end of the lever shaft while extending perpendicularly to the lever shaft, a smaller-diameter shaft extending from the other end of the lever shaft such that it is arranged concentrically with the lever shaft, and a roller rotatably fitted around the smaller-diameter shaft; and a damping unit arranged in the interior of the damper housing, the damping unit being operatively connected to the lever unit in such a manner that it damps a force effecting the movement of the lever unit toward the first position, the damping unit including a U-shaped cylinder defined in the damper housing and contained with a fluid, the cylinder being divided into a first compression chamber and a second compression chamber communicating with each other at lower ends thereof, a check valve arranged at a lower portion of the first compression chamber, the check valve being closed when a fluid in the cylinder flows from the first compression chamber to the second compression chamber while being open when the fluid flows from the second compression chamber to the first compression chamber, a small-diameter communication port formed through the check valve and adapted to communicate the first and second compression chambers with each other, a first plunger arranged in the first compression chamber above the check valve such that it reciprocates vertically, a pushing rod extending vertically from the upper surface of the first plunger and having a tip protruding upwardly through a hole formed in a top wall of the damper housing, the tip of the pushing rod being arranged in a path along which the roller of the lever unit moves together with the damping lever during the movements of the lid, and a second plunger arranged in the second compression chamber such that it reciprocates vertically;

wherein the roller of the lever unit comes into contact with the tip of the pushing rod included in the damping unit in the process of the movement of the lid toward the open position, so that the force effecting the movement of the lid toward the open position to is damped by virtue of the function of the check valve.

2. The damper in accordance with claim 1, further comprising:

a compression coil spring arranged between the first plunger and the check valve and adapted to always urge the first plunger in an upward direction.

3. The damper in accordance with claim 1, further comprising:

a compression coil spring arranged between the second plunger and a top wall portion of the cylinder facing an upper surface of the second plunger, the compression coil spring serving to always urge the second plunger in a downward direction, thereby urging the fluid contained in the second compression chamber to flow toward the first compression chamber.

4. The damper in accordance with claim 1, further comprising:

a first compression coil spring arranged between the first plunger and the check valve and adapted to always urge the first plunger in an upward direction; and a second compression coil spring arranged between the second plunger and a top wall portion of the cylinder facing an upper surface of the second plunger, the second compression coil spring serving to always urge the second plunger in a downward direction, thereby urging the fluid contained in the second compression chamber to flow toward the first compression chamber.

5. A damper used with a lid which is pivotally mounted to an article for maintaining open and closed positions, the damper comprising:

a damper housing fixed to the article and adapted to be connected to the lid;

a lever unit pivotally mounted to the damper housing and connected to the lid to serve as a hinge for the lid, the lever unit pivotally moving between the open and the closed positions; and a damping unit arranged in the damper housing, the damping unit being operatively connected to the lever unit in such a manner that it damps a force effecting the movement of the lever unit toward the closed position, the damping unit including:

a first compression chamber;

a second compression chamber in communication with the first compression chamber;

a communication port connecting the first compression chamber and the second compression chamber; and a plunger disposed in the first compression chamber, the plunger being actuated by the damping unit, wherein the movement of the plunger is attenuated by the movement of fluid from the first compression chamber to the second compression chamber through the communication port.

6. The damper of claim 5, wherein the lever unit comprises:

a lever shaft rotatably fitted in a hole formed in a mounting wall of the damper housing;

a lid connecting lever fixedly connecting the lever shaft to the lid;

a damping lever fixedly mounted to other end of the lever shaft while extending perpendicularly to the lever shaft;

a smaller-diameter shaft extending from the other end of the lever shaft such that it is arranged concentrically with the lever shaft; and a roller rotatably fitted around the smaller-diameter shaft.

7. The damper of claim 6, wherein the damping unit further comprises:

a U-shaped cylinder defined in the damper housing and containing the fluid, the cylinder being divided into the first compression chamber and the second compression chamber communicating with each other at lower ends thereof; and a check valve in the first compression chamber, the check valve being closed when the fluid in the cylinder flows from the first compression chamber to the second compression chamber while being open when the fluid flows from the second compression chamber to the first compression chamber.

8. The damper of claim 7, wherein the damping unit further comprises:

a first plunger arranged in the first compression chamber above the check valve such that it reciprocates vertically;

a pushing rod extending vertically from the upper surface of the first plunger and having a tip protruding upwardly through a hole formed in a top wall of the damper housing, the tip of the pushing rod being arranged in a path along which the roller of the lever unit moves together with the damping lever during the movements of the lid; and a second plunger arranged in the second compression chamber such that it reciprocates vertically, wherein the roller of the lever unit comes into contact with the tip of the pushing rod included in the damping unit in the process of the movement of the lid toward the open position, so that the force effecting the movement of the lid toward the open position is damped by the operation of the check valve.

9. The damper of claim 8, further comprising:

a compression coil spring arranged between the first plunger and the check valve and adapted to always urge the first plunger in an upward direction.

10. The damper of claim 8, further comprising:

a compression coil spring arranged between the second plunger and a top wall portion of the cylinder facing an upper surface of the second plunger, the compression coil spring serving to always urge the second plunger in a downward direction, thereby urging the fluid contained in the second compression chamber to flow toward the first compression chamber.

11. The damper of claim 8, further comprising:

a first compression coil spring arranged between the first plunger and the check valve and adapted to always urge the first plunger in an upward direction; and a second compression coil spring arranged between the second plunger and a top wall portion of the cylinder facing an upper surface of the second plunger, the second compression coil spring serving to always urge the second plunger in a downward direction, thereby urging the fluid contained in the second compression chamber to flow toward the first compression chamber.

* * * * *